US011094441B2

(12) United States Patent
Seene et al.

(10) Patent No.: US 11,094,441 B2
(45) Date of Patent: Aug. 17, 2021

(54) MAGNETIZATION OF A HOLLOW SHAFT

(71) Applicant: NCTE AG, Oberhaching (DE)

(72) Inventors: Christian Seene, Aying (DE); Marianne Hamp, Sauerlach (DE)

(73) Assignee: NOTE AG, Oberhaching (DE)

( * ) Notice: Subject to any disclaimer, the term of this patent is extended or adjusted under 35 U.S.C. 154(b) by 325 days.

(21) Appl. No.: 16/313,529

(22) PCT Filed: Mar. 27, 2017

(86) PCT No.: PCT/EP2017/057153

§ 371 (c)(1),
(2) Date: Dec. 27, 2018

(87) PCT Pub. No.: WO2018/010855

PCT Pub. Date: Jan. 18, 2018

(65) Prior Publication Data

US 2019/0318859 A1 Oct. 17, 2019

(30) Foreign Application Priority Data

Jul. 12, 2016 (EP) ..... 16179056

(51) Int. Cl.
*H01F 13/00* (2006.01)
*H01F 7/02* (2006.01)

(52) U.S. Cl.
CPC ..... *H01F 7/0273* (2013.01); *H01F 13/003* (2013.01)

(58) Field of Classification Search
CPC ..... H01F 7/0273; H01F 13/003
(Continued)

(56) References Cited

U.S. PATENT DOCUMENTS 2,963,645 A * 12/1960 Walkup ..... G01N 27/9006 335/284
2009/0026864 A1* 1/2009 Ichiyama ..... H02K 21/028 310/154.28

(Continued)

FOREIGN PATENT DOCUMENTS

DE 102012004105 A1 9/2013
EP 1774217 A1 4/2007

(Continued)

*Primary Examiner* — Shawki S Ismail
*Assistant Examiner* — Lisa N Homza
(74) *Attorney, Agent, or Firm* — Coats & Bennett, PLLC

(57) ABSTRACT

The present invention discloses an apparatus for magnetizing a ferromagnetic, electrically conductive hollow shaft, the apparatus comprising: an electrically conductive rod-like element for generating one or a plurality of magnetic fields by means of an internal contact device arranged thereon and used for contacting with an inner contact region on an inner side of the hollow shaft; an external contact device for contacting with an outer contact region on an outer side of the hollow shaft; and a current source for generating a current pulse through the rod-like element, the internal contact device and the external contact device and also through the hollow shaft between the inner and outer contact regions; wherein a first pole of the current source is connected to or adapted to be connected to at least one current supply contact point of the rod-like element and a second pole of the current source is connected to or adapted to be connected to the external contact device, and wherein an electrical polarity of the first pole is opposite to the electrical polarity of the second pole. The invention further discloses a corresponding method.

9 Claims, 2 Drawing Sheets

(58) Field of Classification Search
USPC ..... 335/284
See application file for complete search history.

(56) References Cited

U.S. PATENT DOCUMENTS

| | | | | |
|---|---|---|---|---|
| 2009/0173504 | A1 | 7/2009 | McElkimney et al. | |
| 2009/0278641 | A1* | 11/2009 | Hedayat | G01B 7/003 335/284 |
| 2011/0241811 | A1* | 10/2011 | Ihara | H01F 7/0205 335/302 |
| 2012/0188035 | A1* | 7/2012 | Ball, Sr. | H01F 13/003 335/284 |
| 2013/0207757 | A1* | 8/2013 | May | H01F 13/003 335/284 |
| 2013/0283600 | A1* | 10/2013 | Mongeau | H02K 15/03 29/598 |
| 2015/0230810 | A1* | 8/2015 | Creighton | A61K 41/0028 604/518 |
| 2017/0204905 | A1* | 7/2017 | Daniel | H01F 6/00 |

FOREIGN PATENT DOCUMENTS

| | | | |
|---|---|---|---|
| EP | 1902287 | B1 | 4/2010 |
| JP | 2002513147 | A | 5/2002 |
| JP | 2007417206 | A2 | 7/2005 |
| JP | 2007417206 | A | 6/2007 |
| WO | 9737362 | A1 | 10/1997 |
| WO | 9956099 | | 11/1999 |
| WO | 2013127721 | A1 | 9/2013 |
| WO | 2016096190 | A1 | 6/2016 |

* cited by examiner

MAGNETIZATION OF A HOLLOW SHAFT

FIELD OF THE INVENTION

The present invention relates to an apparatus for magnetizing a hollow shaft and a corresponding method.

PRIOR ART

The prior art in magnetizing force-transmitting components (e.g. shafts) for utilizing magnetostrictive measurement technology (e.g. for torque measurement) is, on the one hand, direct electric contacting. By such contacting, respective current pulses are conducted through the component so as to generate the remnant magnetization required for magnetostrictive measurement. This method is described in EP 1774271 B1 and EP 1902287 B1. This method is known under the name of "Pulse Current Magnetic Encoding (PCME)". This involves external contacting at two spaced-apart points on the shaft between which magnetization is to take place as well as generating a current pulse in the axial direction of the shaft, said current pulse magnetizing the shaft in the circumferential direction through the magnetic field thus produced.

On the other hand, DE 102012004105 A1 discloses a contactless magnetization of hollow shafts that are only open on one side, this magnetization differing from the above-described one. In this case, a current is inputted and outputted on the open side of the hollow shaft. The inputted current magnetizes the shaft and, due to an intermediate magnetic shielding, demagnetization through the outputted current is prevented.

However, the methods used at present have the drawbacks mentioned hereinafter. The three different contact points of the PCME method lead to an unequal current distribution around the circumference of the shaft, since the individual contactings do not have the same resistance under realistic conditions. Contactless magnetization of hollow shafts does not work, especially not with small inner diameters, since the shielding of the current required for magnetization must be thicker than the inner diameter of the shaft. The penetration depth d of an alternating electromagnetic field with the frequency f is:

$$d=\sqrt{(\pi f\sigma\mu_r\mu_0)^{-1}},$$

wherein $\sigma$ is the electrical conductivity and $\mu_r$ the relative permeability of the shielding material and $\mu_0$ the permeability constant.

In view of these drawbacks of the prior art, it is an object of the present invention to provide a method suitable for accomplishing a magnetization of a shaft, which overcomes one or a plurality of the above-mentioned drawbacks.

DESCRIPTION OF THE INVENTION

It is the object of the present invention to provide an apparatus and a method, which are suitable for accomplishing a uniform magnetization of a hollow shaft in a circumferential direction, in particular also of a hollow shaft with a small inner diameter.

This object is achieved by an apparatus for magnetizing a ferromagnetic, electrically conductive hollow shaft according to claim 1.

The apparatus according to the present invention comprises an electrically conductive rod-like element for generating one magnetic field or a plurality of magnetic fields by means of an internal contact device arranged on the rod-like element and used for contacting with an inner contact region on an inner side of the hollow shaft; an external contact device for contacting with an outer contact region on an outer side of the hollow shaft; and a current source for generating a current pulse through the rod-like element, the internal contact device and the external contact device and also through the hollow shaft between the inner and outer contact regions. A first pole of the current source is here connected to or adapted to be connected to at least one current supply contact point of the rod-like element and a second pole of the current source is connected to or adapted to be connected to the external contact device, and an electrical polarity of the first pole is opposite to the electrical polarity of the second pole.

According to the present invention, the flow of current is (other than in the case of the PCME method) not conducted in the shaft area to be magnetized, but the magnetizing current flows in the rod-like element. This leads to a uniform magnetization of the hollow shaft in a circumferential direction. The flow of current in the shaft from the inside to the outside, or vice versa, only serves to close the electric circuit between the internal and the external contact device. The rod-like element may, in turn, be a hollow rod.

A further development of the apparatus according to the present invention is to be seen in that the external contact device may comprise an electrically conductive cylindrical element, in which at least part of the hollow shaft can be arranged during magnetization. By means of the cylindrical element, the current can be supplied to and discharged from the contact points on the outer side. Instead of the cylindrical element, or additionally thereto, also a wiring may be provided, by means of which a connection to the current source can be established.

According to another further development, the internal contact device and the external contact device may be arranged radially opposite each other with respect to the hollow shaft. This minimizes the flow of current in the axial direction of the hollow shaft, since the current can flow directly in the radial direction of the shaft.

In another further development, the internal contact device and/or the external contact device may be annular in shape. This provides a particularly uniform kind of contacting.

According to another further development, the internal contact device and/or the external contact device may comprise a plurality of internal and/or external contact elements, which are arranged in respective circles, the contact elements being preferably spring biased in the direction of the hollow shaft to be magnetized. In this way, the flow of current through the hollow shaft can be distributed over the circumference of the latter. In particular, due to the spring bias, hollow shafts with different diameters can be contacted on the one hand, and, on the other hand, contacting as such is guaranteed by pressing the contact elements against the hollow shaft.

An identical number of inner and outer contact elements may be provided, and this additionally leads to a uniform distribution of the flow of current.

Preferably, the internal and/or external contact elements are arranged at regular angular distances from one another in the circumferential direction of the hollow shaft. This leads to a homogenization of the flow of current through the shaft.

In another further development, two current supply contact points may be provided and the internal contact device may be arranged on the rod-like element between the two current supply contact points of the rod-like element, both current supply contact points being electrically connectable to the first pole of the current source, or one current supply contact point being electrically connected to the first pole of the current source and the other current supply contact point being electrically connectable to the first pole of the current source. It follows that, according to this further development, a respective flow of current from both current supply contact points of the rod-like element to the internal contact device (or, in an opposite direction, starting from the internal contact device and directed towards the two current supply contact points) will generate two currents in opposite directions, whereby the hollow shaft will be magnetized in opposite circumferential directions.

The object of the present invention is also achieved by a method of magnetizing a ferromagnetic, electrically conductive hollow shaft according to claim 8.

The method according to the present invention comprises the following steps: inserting an electrically conductive rod-like element, which has an internal contact device arranged thereon, into a hollow space of the hollow shaft, preferably such that the rod-like element is arranged on and along an axis of the hollow shaft, and contacting the internal contact device with an inner contact region on an inner side of the hollow shaft; contacting an external contact device with an outer contact region on an outer side of the hollow shaft; and generating a current pulse through the rod-like element, the internal contact device and the external contact device and also through the hollow shaft between the inner and outer contact regions, the hollow shaft being magnetized with the thus generated magnetic field of the rod-like element through which the current flows. Inserting the electrically conductive rod-like element into the hollow space of the hollow shaft may, in particular, comprise passing the rod-like element through the hollow space of the hollow shaft such that, subsequently, the respective opposite end portions of the rod-like element are arranged outside the hollow shaft.

The advantages of the method according to the present invention and the further developments thereof correspond to those of the apparatus according to the present invention and the further developments thereof, and the above statements are herewith referred to.

According to a further development, the step of arranging the hollow shaft in an electrically conductive cylindrical element of the external contact device may be provided, the axis of the hollow shaft being arranged preferably on and along an axis of the cylindrical element.

The internal contact device and the external contact device may be arranged radially opposite each other with respect to the hollow shaft.

The internal contact device and/or the external contact device may be annular in shape, and the rings can be brought into contact with the inner side and/or the outer side of the hollow shaft.

The internal contact device and/or the external contact device may comprise a plurality of internal and/or external contact elements, which are arranged in respective circles and which can be brought into contact with the inner side and/or the outer side of the hollow shaft.

An identical number of internal and external contact elements may be provided, and respective internal and external contact elements may be arranged radially opposite each other with respect to the hollow shaft.

The internal and/or external contact elements may be arranged at regular angular distances from one another in the circumferential direction of the hollow shaft.

Prior to generating the current pulse, the following additional steps may be provided: connecting at least one current supply contact point of the rod-like element to a first pole of a current source, connecting the external contact device to a second pole of the current source, with an electrical polarity of the first pole being opposite to the electrical polarity of the second pole. In particular, two current supply contact points of the rod-like element arranged opposite each other with respect to the internal contact device may be connected to the first pole, or one of the current supply contact points may be connected permanently to the first pole and the second current supply contact point may be connected to the first pole after insertion of the rod-like element into the hollow space of the hollow shaft.

The material of the hollow shaft comprises preferably steel.

The above-mentioned further developments may be used individually or they may be combined with one another in a suitable manner as claimed.

Further features and exemplary developments as well as advantages of the present invention will be explained in more detail hereinafter making reference to the drawings. It goes without saying that the embodiments do not exhaust the scope of the present invention. In addition, it goes without saying that some of the features or all the features described hereinafter may also be combined with one another in some other way.

EMBODIMENTS

Figure 1:
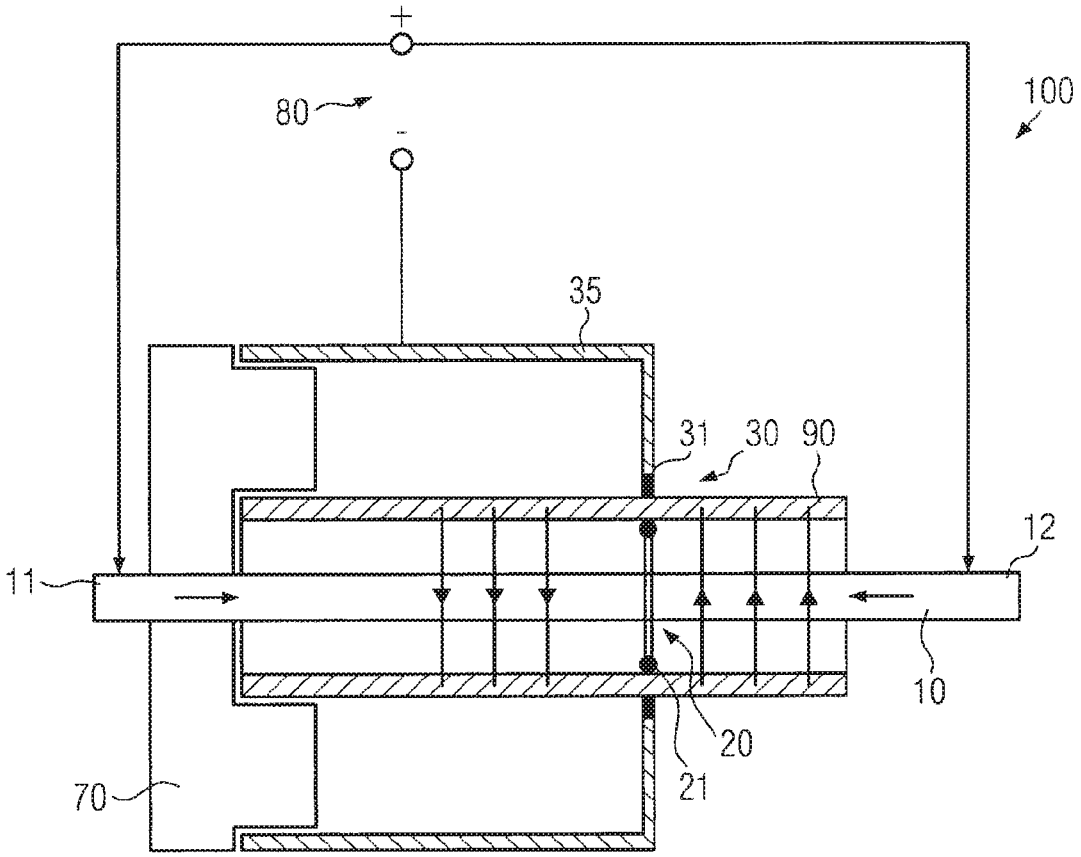
FIG. 1 shows a first embodiment of the apparatus according to the present invention.

In FIG. 1 a first embodiment of the apparatus according to the present invention is shown.

In the first embodiment 100 of the apparatus according to the present invention for magnetizing a ferromagnetic, electrically conductive hollow shaft 90, the apparatus comprises an electrically conductive rod-like element 10 for generating a magnetic field by means of an internal contact device 20 arranged thereon and used for contacting with an inner contact region on an inner side of the hollow shaft 90; an external contact device 30 for contacting with an outer contact region on an outer side of the hollow shaft 90; and a current source 80 for generating a current pulse through the rod-like element 10, the internal contact device 20 and the external contact device 30 and also through the hollow shaft 90 between the inner and outer contact regions.

The external contact device 30 comprises an electrically conductive cylindrical element 35, in which the hollow shaft 90 is arranged during magnetization. By means of the cylindrical element 35, the current can be supplied to and discharged from the contact points on the outer side. The cylindrical element 35 and the rod-like element 10 are arranged for mounting in a basic body 70 which electrically insulates the two elements. The internal contact device 20 and the external contact device 30 are arranged radially opposite each other with respect to the hollow shaft, the internal contact device 20 and the external contact device 30 comprising a plurality of internal contact elements 21 and external contact elements 31, which are arranged in respective circles, the contact elements 21, 31 being spring biased in the direction of the shaft 90 to be magnetized. The lines provided with arrows indicate the directions of the magnetic fields induced in the hollow shaft 90 by the rod-shaped element 10 through which the current flows.

Two current supply contact points 11, 12 are provided and the internal contact device 20 is arranged on the rod-like element 10 between the two current supply contact points 11, 12 of the rod-like element 10, one current supply contact point 11 being permanently electrically connected to the first pole of the current source 80 and the other current supply contact point 12 being connected to the first pole of the current source 80 after insertion of the hollow shaft 90 (after the hollow shaft 90 has been put over the rod 10). The second pole of the current source 80 is connected to the external contact device 30. The electrical polarity of the first pole is opposite to the electrical polarity of the second pole. According to the present embodiment, a respective flow of current from both current supply contact points 11, 12 of the rod-like element 10 to the internal contact device 20 generates two currents in opposite directions (see arrows in the rod-like element 10), the hollow shaft 90 being thus magnetized in opposite circumferential directions.

Figure 2:
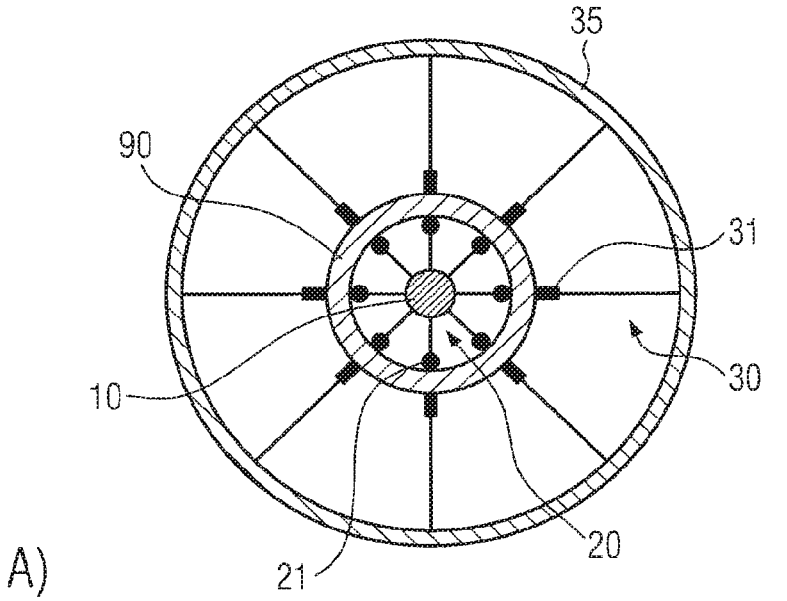
FIG. 2 shows two embodiments for contacting in the apparatus according to the present invention.
Figure 2:
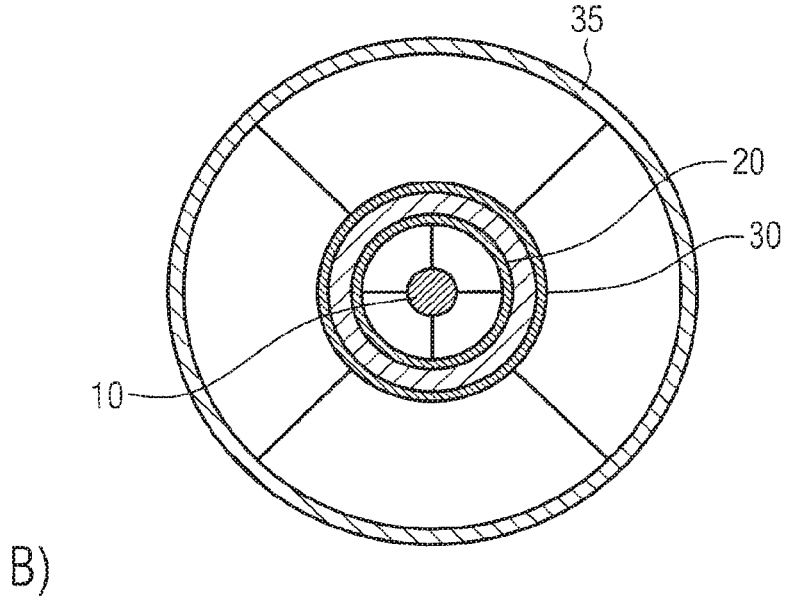

In FIG. 2A, B, two embodiments for contacting in the apparatus according to the present invention are shown in cross-section. Like reference numerals identify here components corresponding to those shown in FIG. 1.

In the upper drawing (FIG. 2A), the internal contact elements 21 are provided in a circle around the rod 10 and are each in contact with an inner side of the hollow shaft 90. The respective external contact elements 31 are arranged in radially opposed relationship for thus restricting the flow of current through the hollow shaft preferably in a radial direction and, in particular, avoid a flow of current in an axial direction of the hollow shaft 90, whereby magnetic interference fields with respect to the desired magnetization may be caused.

In the lower drawing (FIG. 2B), the internal contact device 20 comprises a ring for contacting the hollow shaft from inside and also the external contact device 30 comprises a ring for contacting the hollow shaft 90 from outside. Both rings are arranged in radially opposed relationship for the same reasons.

The embodiments shown are only of an exemplary nature and the full scope of the present invention is defined by the claims.

The invention claimed is:

1. An apparatus for magnetizing a ferromagnetic, electrically conductive hollow shaft, the apparatus comprising:

an electrically conductive rod-like element for generating at least one magnetic field via an internal contact device arranged thereon, the internal contact device used for contacting with an inner contact region on an inner surface of the hollow shaft;

an external contact device for contacting with an outer contact region on an outer surface of the hollow shaft;

a current source for generating a current pulse through the rod-like element, the internal contact device, and the external contact device, and also through the hollow shaft between the inner and outer contact regions; wherein the current source has a first pole and a second pole, wherein an electrical polarity of the first pole is opposite to the electrical polarity of the second pole;

wherein the first pole of the current source is connected to or adapted to be connected to at least one current supply contact point of the rod-like element;

wherein the second pole of the current source is connected to or adapted to be connected to the external contact device;

wherein two current supply contact points are provided;

wherein the internal contact device is arranged on the rod-like element between the two current supply contact points;

wherein:

both current supply contact points are electrically connectable to the first pole of the current source; or one current supply contact point is electrically connected to the first pole of the current source and the other current supply contact point is electrically connectable to the first pole of the current source.

2. The apparatus of claim 1, wherein the external contact device comprises an electrically conductive cylindrical element configured to receive least part of the hollow shaft.

3. The apparatus of claim 1, wherein the internal contact device and the external contact device are arranged radially opposite each other with respect to the hollow shaft.

4. The apparatus of claim 1, wherein:

the internal contact device is annular in shape, and/or the external contact device is annular in shape.

5. The apparatus of claim 1:

wherein the internal contact device comprises a plurality of inner contact elements arranged in a circle, the internal contact elements spring biased toward the hollow shaft to be magnetized; or wherein the external contact device comprises a plurality of external contact elements arranged in a circle, the external contact elements spring biased toward the hollow shaft to be magnetized.

6. The apparatus of claim 5, wherein:

the internal contact elements are arranged at regular angular distances from one another in the circumferential direction of the hollow shaft; or the external contact elements are arranged at regular angular distances from one another in the circumferential direction of the hollow shaft.

7. The apparatus of claim 1:

wherein the internal contact device comprises a plurality of inner contact elements arranged in a circle, the internal contact elements spring biased toward the hollow shaft to be magnetized; and wherein the external contact device comprises a plurality of external contact elements arranged in a circle, the external contact elements spring biased toward the hollow shaft to be magnetized.

8. The apparatus of claim 7, wherein a number of internal contact elements and a number of external contact elements is equal.

9. The apparatus of claim 7, wherein:

the internal contact elements are arranged at regular angular distances from one another in the circumferential direction of the hollow shaft; and the external contact elements are arranged at regular angular distances from one another in the circumferential direction of the hollow shaft.

* * * * *